United States Patent [19]

Butler

[11] Patent Number: 4,741,645

[45] Date of Patent: May 3, 1988

[54] CONTINUOUS GUTTER LINING

[76] Inventor: Richard W. Butler, 3702 E. 100 North, Marion, Ind. 46952

[21] Appl. No.: 15,429

[22] Filed: Feb. 17, 1987

[51] Int. Cl.[4] ..... E04D 13/06; E02B 5/02

[52] U.S. Cl. ..... 405/118

[58] Field of Search ..... 405/118–123; 52/11–16; 210/154

[56] References Cited

U.S. PATENT DOCUMENTS

| | | | |
|---|---|---|---|
| 2,170,671 | 8/1939 | Adler | 405/118 |
| 2,408,557 | 10/1946 | Huntington | 52/466 |
| 3,300,911 | 1/1967 | Riddell | 52/16 |
| 3,592,721 | 7/1971 | Formanek et al. | 428/121 |
| 4,190,988 | 3/1980 | Carreiro | 52/16 |
| 4,406,093 | 9/1983 | Good et al. | 52/11 |
| 4,581,857 | 4/1986 | Harbom | 52/12 |
| 4,632,342 | 12/1986 | Skinner | 52/11 X |

FOREIGN PATENT DOCUMENTS

| | | |
|---|---|---|
| 8204457 | 12/1982 | European Pat. Off. . |
| 2547283 | 4/1977 | Fed. Rep. of Germany . |
| 54-19214 | 2/1979 | Japan . |
| 1502137 | 2/1978 | United Kingdom . |

*Primary Examiner*—Randolph A. Reese
*Assistant Examiner*—John A. Ricci
*Attorney, Agent, or Firm*—Jeffers, Hoffman & Niewyk

[57] ABSTRACT

A method and apparatus for the repair of leaky gutters by the installation of a semi-conforming, resilient liner. The liner material is selected for its ability to readily form durable watertight joints with adjoining pieces of similar material, or to itself, to provide a watertight conveyance to the downspout for runoff water. The resiliency of the material is selected such that the liner is generally semi-conformal in order to prevent seepage of water between the liner and the gutter, and to allow easy handling and installation. Finally, the liner presented when installed is durable enough and inexpensive enough to make lining of the gutters to repair the leaks more cost effective than replacement of the leaky gutter with new ones. In one embodiment, PVC material and bonding agents, similar to those commonly used in plastic pipe plumbing, are selected for use.

18 Claims, 2 Drawing Sheets

CONTINUOUS GUTTER LINING

FIELD OF INVENTION

The present invention relates to the field of gutters and more particularly to a waterproof lining for installing into gutters.

Gutters for the collection of rainwater running off of a building roof and the conduction of such runoff water to a downspout have been used on buildings for centuries. The metal type gutters commonly found on residential and small commercial buildings typically were sections of galvanized steel or other metal joined at junction plates and having end pieces connected to the terminal gutter section. These types of gutters were prone to corrosion and leaking especially at the joints and the end pieces where any protective coating typically was removed during manufacture or installation, and because the expansion and contraction of the joint according to the ambient temperature changes left spaces for the accumulation of moisture which further accelerated the corrosion process. As it became available, aluminum, because of its non-corrosive characteristics and its light weight, began to replace other metals as the main material used for the manufacture of gutters. Initially, aluminum gutters were supplied in long sections which were joined by junction plates as were other metal gutters previously, but whatever the method of joining the individual sections, whether it be riveting or some type of joint seam, the junctions between the long straight sections, the corners, and the ends seams often developed leaks over time.

One solution has been to supply the guttering in a continuous length between the ends and any corners, thus doing away with the joint which can leak along straight sections. This is accomplished by measuring the straight lengths required and forming the gutter on-site to the correct length from a continuous roll of aluminum strip. Although this does do away with the leaky joints between straight pieces, it still leaves the problem of leaks developing around end pieces and around corner junction pieces.

The commonly used method of repairing the leaks was and is to coat or caulk the gutter joint with a sealant of some type. The problem with this approach is that the changes in the weather from very hot during the summer to extremely cold during the winter make it very difficult for the sealants to maintain a water tight seal. The gutter is constantly expanding and contracting with the environmental temperature and unless the sealer can expand and contract at the same rate, a stress tending to pull the sealant away from the metal joint to be sealed is formed. A further problem with using sealants is that for butt joints and for corner joints, an accumulation of sealant in the bottom of the gutter will prevent proper draining and encourage an accumulation of water in the gutter up to the height of the sealant. In winter, especially, this can lead to a build-up of ice in the gutter which puts an extra weight load on the horizontal supports holding the gutter on the building, and it also puts an extra strain on the butt or corner joint by adding to the total weight which has to be supported. Another problem with using sealants is that the leaky gutters are typically not readily accessible for repeated application of sealant. Often gutters are on a second or third story level which requires the climbing of a tall ladder in order to seal or re-seal the joint.

Often times, just one leak in an otherwise well functioning gutter can in the winter make a very slick spot in the sidewalk, which can be very treacherous to people walking along the sidewalk and thereby lead to a hazardous, intolerable condition.

It is desirable to provide an apparatus for repairing leaky gutters.

It is further desirable to provide a gutter repair apparatus which will not be induced to leak by the climatic temperature variations.

It is further desirable to provide a method for installing the leak repair apparatus with a minimum amount of effort.

SUMMARY OF THE INVENTION

The present invention provides a waterproof liner made of a resilient material which is placed within the gutters and partially conforms to the shape of the gutters providing a seamless, waterproof drainage channel along the straight runs of the gutter. At the ends of the gutter, the resilient strip is attached by a waterproof bond to a preformed end piece of a similar waterproof resilient material. Similarly, at corners, the waterproof, resilient strip is attached by a waterproof bond to a preformed corner of similar waterproof resilient material. A hole in the bottom of the waterproof strip just above the downspout provides an exit for the runoff water to drain into the downspout. Further, a method for easily installing the apparatus of the invention is also provided.

By covering any and all butt joints with a single strip of waterproof resilient material, the straight runs of the gutter are lined with a single, continuous, waterproof lining thereby repairing all existing leaks. At the troublesome corners and end joints, the waterproof liner is overlapped with either one lip of a preformed corner or the lip of a preformed end, as the case may be, and the overlapping area is treated with an agent that forms a permanent waterproof bond in the overlap region between the waterproof resilient strip and the preformed corner or end piece. An analogous bonding to a steel gutter would mean soldering, brazing, or welding, all of which require expensive equipment and are difficult to perform while at roof height. For aluminum gutters, no analogous aluminum-to-aluminum bonding process exists that is practical for rooftop installation. By starting at one end piece and bonding lengths between any intervening corners and finishing at the other gutter end, a leakproof, waterproof resilient liner is installed from end to end and around every corner inside of the existing leaky gutters, thereby fixing the leaks without the expense and the labor of taking them down and putting up new gutters.

The specific embodiment of the invention disclosed comprises a waterproof, resilient strip and preformed pieces of polyvinylchloride, PVC. This material is chosen because it is readily available, it is easily molded, and it is known to have waterproof bonding properties from the use of PVC plastic pipes and joints to supply water within modern residences and businesses. The end pieces, the corner pieces, and a drain piece are all preformed by injection molding or press molding out of PVC at elevated temperatures. The end pieces and the corner piece are formed with an overlap lip region which is designed to overlap either on the inside or on the outside of the waterproof resilient strip in order to accommodate water flows of either direction and yet not leave a joint behind which water will accumulate.

The drain piece has a wide flange which is connected to a short, substantially circular pipe. The wide flange provides an overlap region for bonding to the waterproof resilient strip in the region circumferentially surrounding a drain hole.

The embodiment of the invention disclosed is for the specific application of lining a five inch case style gutter. The five inch case style gutter is substantially rectangular in cross section and typically is suspended from horizontal nails penetrating the gutter near the top of the front and rear sidewalls. The second most commonly used support device for gutters is a metal strap which surrounds a cross section of the gutter entirely and then is nailed to the building eave, to the building roof, or to both. Since it does completely surround a cross section of the gutter, this strap has a substantially horizontal portion traversing the distance from the front wall to the back wall of the gutter. Each long, straight run of the gutter beneath the horizontal supports is lined by a continuous strip of polyvinylchloride gutter liner. The thickness of the strip is selected to give the strip sufficient resilience to form a U-shape cross section when installed in the gutter, instead of being so thin and pliable that the strip would substantially conform to the shape of the five inch case gutter. The edge to edge width of the strip is selected so that the tips of the U-shape are located just under the location of the penetration of a gutter by the gutter nail at the front wall and the back wall of the gutter whether or not gutter nails are actually used. With the width of the material and the resilience of the material thus selected, it is possible for the installer to take a long continuous roll of the PVC strip at one end of a straight run, form the U-shape under the first horizontal support member, and then because of the guidance of the gutter sidewalls and the horizontal support members, the installer can push the gutter liner all the way to the far end of the straight run. Once the gutter is lined to the far end, the strip is further unrolled and trimmed (using everyday tools such as scissors) to the correct length to lie within the gutter at the near end where the installer is located. The installer then laps and glues a preformed end piece on the end that has just been trimmed and cut. At this point the installer climbs down the ladder, moves the ladder to the other end or an intervening corner, as the case may be, and laps and glues either the far end piece or laps and glues a corner. If the gutter liner installation includes a corner, after lapping and gluing the far end of the first straight run to the corner, a second end is inserted below the first horizontal support of the second straight run and pushed as far as possible to the second far end in a similar manner, then while still at the corner, a second near end is trimmed off the roll using ordinary tools and, laying the continuous roll of strip aside for the moment, the unoccupied lip of the corner is lapped and glued to the second near end of the gutter liner.

With any corner properly bonded and installed, the installer finally moves the ladder to the far end of the gutter where a preformed end is lapped and glued. Finally a hole is cut in the gutter liner and optionally a downspout adaptor is lapped and glued below this hole.

In this manner, a complete gutter liner apparatus can be installed in an existing gutter including two ends, any number of corners and at least one downspout in which only a minimum number of trips up and down a ladder are required. Further, the only tools required are common tools such as a knife or scissors.

Preferably, the waterproof, resilient material that this liner is made out of has a light color so as not to absorb heat on sunny days, and also has a resistance to chemical breakdown in the presence of ultraviolet light, such as sunlight.

When the gutter liner is installed, the gutter liner strips, end caps, and any other gutter-liner components form a water-tight liner which repairs any existing leaks easily (as described above), inexpensively, and permanently. The repair is inexpensive because the components are made from common PVC or similar material which is easily produced in sheet form for the continuous strip and is easily molded to form end caps, corners, and downspouts. Further, there is a known bonding agent similar to the one used on PVC pipes to supply the drinking water in homes. Thus, all the needed components are of commonly available, inexpensive materials. This gutter liner is a permanent leak repair because unlike sealants, which try to seal a gap between a metal-to-metal joint, the gutter liner is bonded completely to itself and thereby forms a one-piece, resilient, waterproof gutter within the existing metal gutter which is unaffected by the expansion and contraction of the aluminum, steel, or other metal as the case may be.

Briefly stated, in accordance with one aspect of the invention there is provided an apparatus for lining a gutter between its two ends with a drain hole cut in the lining to allow runoff water to exit the liner and drain through the existing downspout. The first component of the liner is a strip of water-proof, resilient material that is just slightly shorter than the length of the liner which is placed in the gutter with the edges of the strip located beneath the horizontal support members of the gutter. The width of the resilient strip is selected so that the strip will form a U-shape cross section within the gutter with one edge contacting the back wall below the horizontal support member, the other edge contacting the gutter front wall below the horizontal support member, and a rounded central portion of the strip contacting the bottom surface of the gutter. At each end of the resilient strip which is bent into a U-shape, a preformed end piece of a similar waterproof, resilient material is placed in the gutter and bonded in a waterproof manner to the resilient strip. Above the existing gutter downspout, a hole is located in the bottom of the U-shaped, resilient strip to allow the runoff water to drain into the downspout.

In a further aspect of this invention, a preformed downspout of resilient material having a flange attached to a hollow substantially rectangular portion is bonded such that the flange completely surrounds the outside of the drain hole, thereby allowing the runoff water to go through the drain hole through the inside diameter of the flange, down the hollow substantially rectangular portion and then into the existing metal downspout.

In yet a further aspect of the invention, the gutter liner apparatus has a preformed corner piece of similar waterproof, resilient material bonded to the two strips of waterproof, resilient material located between two preformed end pieces which are similarly bonded to the resilient strips. This yet further embodiment has a drain hole located above an existing downspout and optionally may have a resilient downspout bonded to the resilient strip surrounding the drain hole in the manner described above.

In another aspect of the invention, there is provided a method for installing gutter liners into existing gutters which have a front side wall, a rear side wall, a left end, a right end, and a downspout; and which are supported by horizontal members. The method includes: inserting one end of a continuous, strip of waterproof, resilient material beneath the horizontal support members at a near end of the gutter thereby distorting the flat strip into a general U-shape under the influence of the side walls of the gutter and gravity, sliding that one end of the strip to the far end of the gutter beneath all of the horizontal members, cutting the strip to a length slightly shorter than the total inside distance between the ends of the gutter, lapping and bonding the near end of the resilient strip with one preformed end piece of a similar material, moving to the far gutter end, lapping and bonding in a waterproof manner the far end of the resilient strip to another end piece of similar resilient material and cutting a hole in the strip in the region above the existing downspout thereby forming a drain-hole through which runoff water can pass.

In a further aspect of this invention, a method further comprises the step of bonding in a waterproof manner a flanged, resilient downspout adaptor to the resilient strip surrounding the drain hole to facilitate the draining of water into the existing downspout.

It is an object of this invention to provide a leak-free conveyance of runoff water to the downspout within the existing gutters.

It is another object of this invention to provide a leak-free conveyance of runoff water within existing gutters which is easy to install.

It is a further object of the invention to provide a leak-free conveyance of runoff water within existing gutters to an existing downspout using inexpensive and readily available materials.

It is yet another object of this invention to provide a leak-free conveyance within existing gutters for runoff water to an existing downspout which is durable and has a long life.

It is yet another object of the invention to provide an easy method for installing the leak-free conveyance within existing gutters.

These and other objects and features of the present invention will become apparent from the detailed description, taken together with the accompanying drawings.

DETAILED DESCRIPTION

Figure 1:
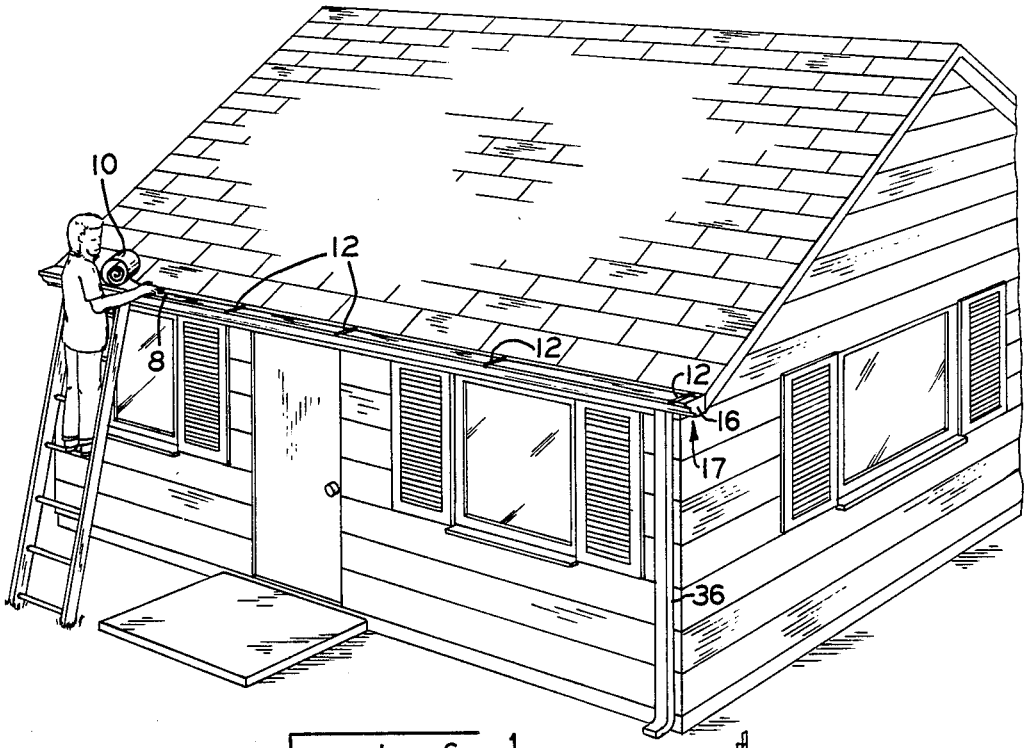
FIG. 1 illustrates a method of installation of a gutter liner into an existing gutter.

Referring now in detail to the drawings where similar designations denote similar elements in the various figures, FIG. 1 illustrates a method of installing a continuous length of gutter liner strip 8 from a continuous roll 10 of the gutter liner strip material. The outer end of the continuous roll 10 of gutter liner strip 8 is inserted under the nearest horizontal support, such as nail 12, of the case gutter 16. The resilience of the gutter liner strip 8 and its tendency to attain its original flat shape prevents it from conforming to the generally rectangular cross-sectional shape of case gutter 16, and forming instead the typical U-shape, as shown in FIG. 2, within the gutter 16 and beneath the horizontal supports 12.

Figure 2:
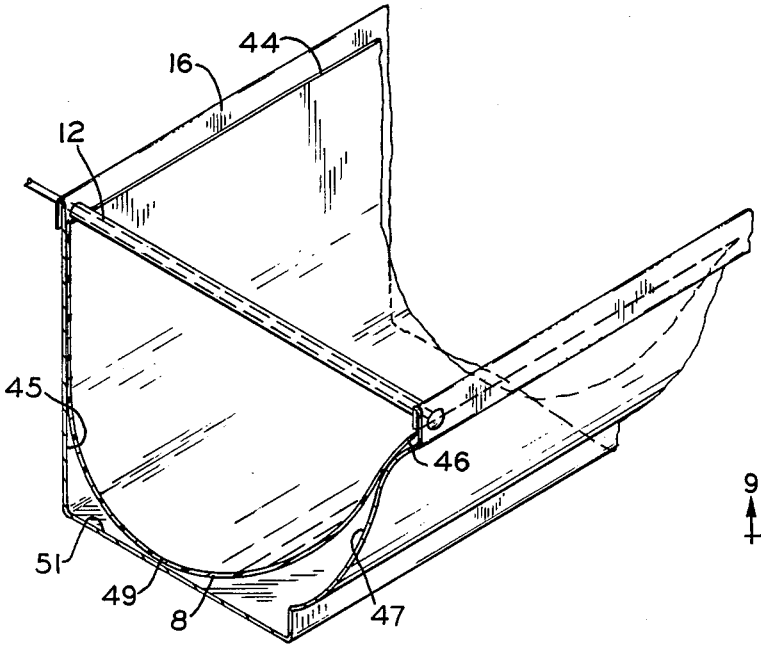
FIG. 2 shows in a cross-sectional perspective view a typical shape that the gutter liner assumes upon installation in a case style gutter.

The resiliency of the gutter liner strip 8 is selected such that it will form this general U-shape shown in FIG. 2. If the gutter liner were less resilient, the diminution in lateral and longitudinal stiffness would make it difficult to install in the manner described above and shown in FIG. 1 as it would tend to fold and bind within the gutter 16 as it was pushed along. Similarly, if the gutter liner were too stiff, then the outer, inserted end tends to ride up out of the gutter 16 between the horizontal supports 12 and cannot easily be inserted from one end. Rather, it must be guided individually below each horizontal support 12.

Figure 7:
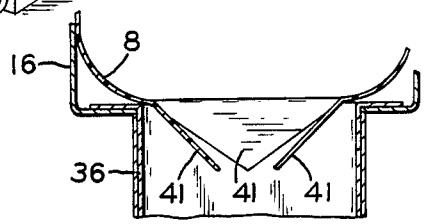
FIG. 7 is a sectional view showing the interconnection between the gutter liner and a downspout.
Figure 3:
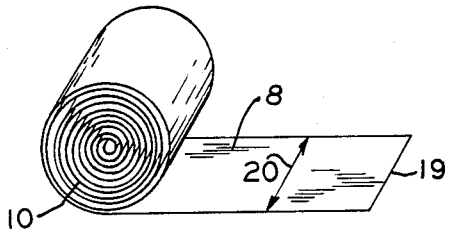
FIG. 3 i11ustrates a continuous roll of resilient gutter liner strip.

As is well known, the resilience and stiffness is a function of the thickness of the gutter liner strip 8, the width 20 (FIG. 7) of the gutter liner strip 8, and the bulk modulus for the material selected. In one embodiment of the invention, the material of the continuous strip shown in FIG. 3 is polyvinylchloride (PVC). The thickness of the strip in this one embodiment is in the range of 8 to 10 mils (i.e.,0.008 to 0.010 inches) and the width is 8½ inches. This combination provides a gutter liner strip which can be inserted in one end of a gutter 16 and has sufficient stiffness and resilience to be urged to the far end 17 of the gutter 16 by unrolling the strip 8 from the continuous roll 10 and feeding the gutter liner strip 8 under the horizontal supports 12 until the outside end after roll 10 reaches the far end 17 of the gutter 16.

Figure 4:
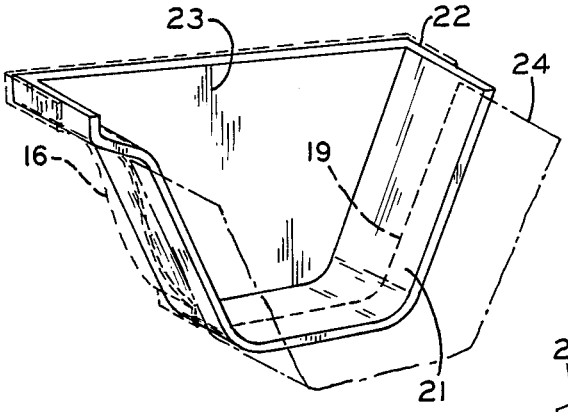
FIG. 4 shows a perspective view of a molded left end cap and a junction with a gutter liner strip.
Figure 5:
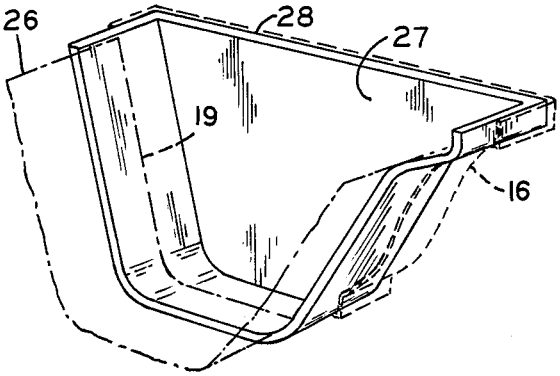
FIG. 5 shows in a perspective view a molded right end cap and the right end junction with a gutter liner strip.

Once the edge 19 of gutter liner strip 8 either touches or nearly touches the far end 17 of the gutter 16, the installer unrolls from continuous roll 10 a length of gutter liner strip sufficiently long to either touch or nearly touch the near end of gutter 16 and then using scissors or another cutting device, cuts the thus measured length of gutter liner strip 8 from the continuous roll 10. While still on the ladder as shown in FIG. 1, the installer inserts and overlaps the molded plastic left end cap 22 with the near end 24 of the gutter liner strip 8, as shown in FIG. 4, and then glues the molded left end, 22, to near end 24 along the overlap region 21 shown in FIG. 4. At this point, the installer is finished at this portion of gutter 16 and moves the ladder to the far end of the gutter 16 where the installer glues the far end 26 (FIG. 5) to the outside of right end cap 28. The lapping described for FIGS. 1, 4 and 5 follows the general installation principle that the uphill component should always be lapped above the downhill component in order to prevent the overlap from collecting water. The glue used between the overlapped components is one that is known and has been used for forming waterproof joints between PVC components. End caps 22 and 28 preferably generally conform to the shape of gutter 16 and are made of molded plastic such as PVC. End caps include end walls 23 and 27, respectively, and are received in gutter 16.

Figure 6:
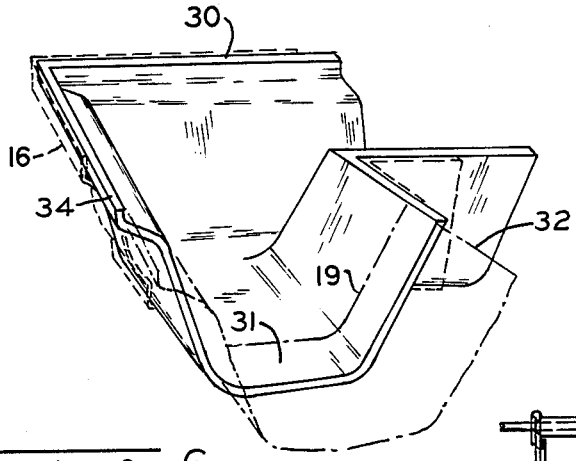
FIG. 6 shows in a perspective view a molded corner piece and one of the junctions with a gutter liner strip.

In another embodiment of the invention, the installer begins at one end of a gutter 16 and urges the outside end of a first length of gutter liner strip 8 from a continuous roll 10 until it reaches or nearly reaches a corner of the gutter (FIG. 6). The installer then cuts the first length of gutter liner strip 8 off continuous roll 10 such that it reaches or almost reaches the near end of the gutter 16 where the installer is located. Before leaving the near end, the installer laps and glues an end cap to the gutter liner strip 8 as described above in the previous embodiment. The installer subsequently moves to the next immediate corner of the gutter and installs a molded corner piece, such as outside corner 30, shown in FIG. 6, that fits within gutter 16 or an inside corner (not shown). At this point, the installer laps the gutter liner strip 8 on the inside of the overlap region 31 of the corner piece 30 if the corner is downhill or to the outside of the corner 30 if the corner is located uphill from the first length of gutter liner strip 8 just installed, and glues the two pieces together. While still located at this corner, the installer runs another length of gutter liner strip 8 to or nearly to a further corner or, if there are no further corners, to the other end of the gutter 16. A second near end 32 of the second length of gutter liner strip 8 is measured and cut off of the continuous roll 10 and subsequently lapped and glued according to the previously stated lapping principle, to the end 34 of the corner element 30. If there are further corners of the gutter, the process just described is repeated until all corners and gutter strip lengths between corners have been installed. Finally, the last gutter liner strip length far end at the far end of gutter 16 is installed as in the embodiment shown in FIG. 1 and described previously.

The U-shaped gutter liner 8, the left end cap 22, the right end cap 28 and any corner piece 30 when installed and properly glued and lapped form a water-tight guttering system for the collection and conveyance of runoff water through existing leaky guttering. The drain hole into the downspout 36 can be formed by incising an "X" cut in the bottom of gutter liner 8 (FIG. 7) in the region immediately above downspout 36 with either a knife or scissors. The length and width of the "X" incised in the gutter liner are slightly smaller than the respective length and width of the rectangular downspout 36 typically used with case style gutters. In one embodiment of the invention, four flaps 41 are formed by the "X" shaped incision and they are folded down into the downspout 36 thereby forming a drain thereunto.

Figure 8:
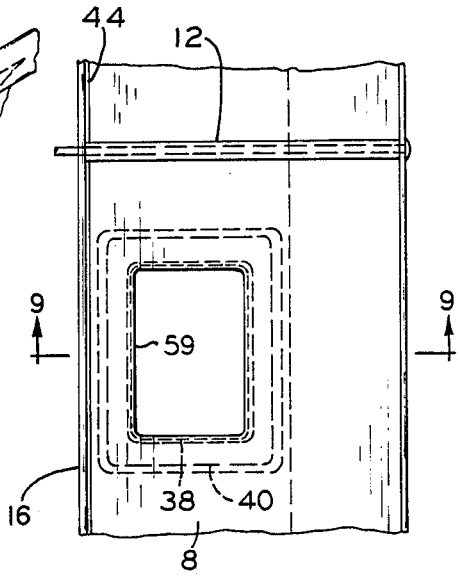
FIG. 8 is a plan view of a downspout adapter embodiment of the present invention.
Figure 9:
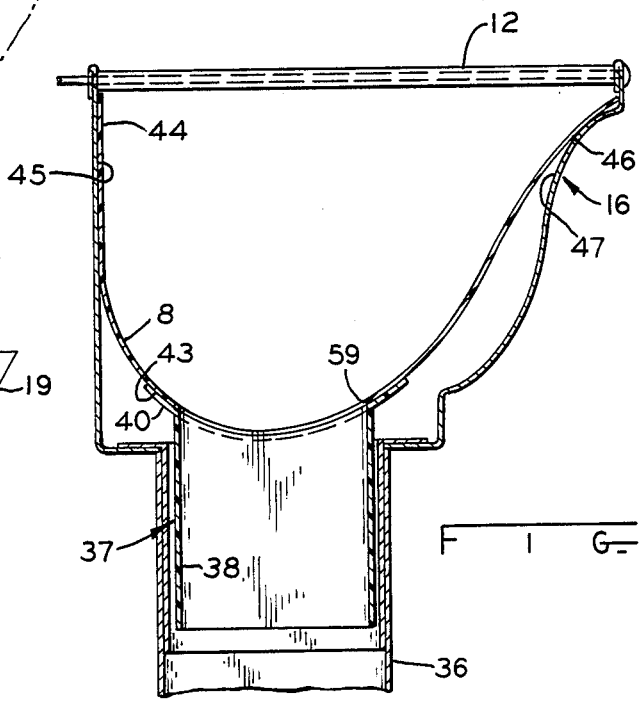
FIG. 9 is a sectional view of FIG. 8 taken along line 9—9 and viewed in the direction of the arrows.

In another embodiment of the invention, a downspout adapter 37 (FIGS. 8 and 9) has a flange 40 glued to the bottom 43 of the gutter liner 8 in the region immediately above downspout 36, and tubular portion 38 extends downwardly into downspout 36. Subsequently, a hole 59 is made in the gutter liner strip 8 immediately above downspout adapter 37, such that the runoff water in gutter liner strip 8 can drain into the downspout adapter 37 and from there into the existing downspout 36. Since the downspout adapter flange 40 is lapped and glued to the underside 43 of the gutter liner 8, there is no lap ridge on the inside of the gutter liner to collect water or debris.

When thus installed, a water-tight apparatus including two end caps and any intervening corners is formed up to the drain for the ultimate drainage of runoff water into the existing downspout. Referring again to FIG. 2, it should be noted how the rear edge 44 and the front edge 46 of the resilient gutter liner strip 8 are held against the inside surfaces 45 and 47 of the case style gutter 16 and against fastener 12 by the resilient force tending to restore liner 8 to the substantially flat cross section in which it is supplied in a continuous roll. Rear edge 44 and front edge 46 therefore bear tightly against the back edge 45 and front edge 47, respectively, of gutter 16 forming gutter-to-liner joints which are highly resistant to leakage of water running off the roof overhang 48. Bottom 49 preferably rests on the bottom 51 of gutter 16. Even if the gutter 16 changes position under the influence of expansion/contraction or other forces relative to the gutter liner strip 8, end caps 22, 28, corner 30, and downspout adapter 37, if present, function to hold the gutter liner system waterproof and in place within the gutter 16. Furthermore, the resiliency of the gutter liner will renew the leak resistant seal of the edges 44 and 46 with the back and front edges 45 and 47 of gutter 16.

The preferred embodiment of gutter liner strip 8, molded end caps 22, 28, molded corner 30, and downspout adapter 37 uses PVC as the preferred resilient material which is glued together at waterproof joints to form a waterproof guttering system. PVC was chosen because it is readily available and can form waterproof joints between individual PVC pieces through the application of known glues or bonding agents. Other thermoplastics or elastomers which are readily available and readily form waterproof seals between individual parts of similar material could be used in alternative embodiments of the invention. The material used is preferably of a light color in order to reflect instead of absorb heat and is of a formulation which resists breakdown of the material in the presence of ultraviolet light inasmuch as the gutter liner may be exposed to large amounts of sunlight. The invention is not limited to the particular style of gutter shown, and can be used with a wide variety of styles and shapes of gutter.

While this invention has been described as having a preferred design, it will be understood that it is capable of further modification. This application is, therefore, intended to cover any variations, uses or adaptations of the invention following the general principles thereof and including such departures from the present disclosure as come within known or customary practice in the art to which the invention pertains and falls within the limits of the appended claims.

What is claimed is:

1. A method for installing a gutter liner apparatus into gutters having a front sidewall, a rear sidewall, a left end, a right end, and a downspout, and said gutter supported by horizontal members, comprising the steps of:

inserting a first end of a continuous flat strip of waterproof, resilient material beneath said horizontal support members at a first end of said gutter, deforming said flat strip to a generally U-shape under the influence of the side walls of said gutter;

sliding said first end of said strip to a second end of said gutter beneath said horizontal members;

lapping and affixing in a watertight manner said strip second end to a first gutter-liner end piece;

lapping and affixing in a watertight manner said strip first end with a second gutter-liner end piece; and making an incision in said strip in the region above said downspout forming a drain hole opening communicating with said downspout.

2. A method according to claim 1 further comprising the step of affixing in a watertight manner said gutter-liner to a downspout adapter extending into said downspout.

3. A method for installing a gutter liner apparatus into gutters having a front sidewall, a rear sidewall, a first end, a second end, a corner, and a downspout, said gutter being supported by horizontal members, comprising the steps of:

installing a first flat strip of waterproof, resilient material beneath said horizontal support members between the first end and the corner of said gutter;

forming said flat strip into a generally U-shape under the influence of the side walls of the gutter;

lapping and affixing in a watertight manner a first end of said strip with a first gutter-liner end piece;

installing a second flat strip of waterproof resilient material beneath said horizontal support members between said corner of said second end of said gutter;

forming said flat strip into a generally U-shape under the influence of the side walls of the gutter;

lapping and affixing in a watertight manner said first strip second end with a first end of a corner gutter-liner piece;

lapping and affixing in a watertight manner a first end of said second strip with a second end of said corner gutter-liner piece;

lapping and affixing in a watertight manner a second end of said second strip with a second gutter-liner end piece;

making an incision in said strip in the region above said downspout forming a drain hole for communicating with said downspout.

4. A method according to claim 3 further comprising the step of affixing said gutter-liner to a flange of a downspout adapter extending into said downspout.

5. An apparatus for lining a gutter having a downspout and horizontal support members, comprising:

a strip of waterproof, normally flat, resilient material of substantially uniform cross section having a drain hole therein;

said strip being resiliently deformed out of its flat shape to a U-shaped transverse cross-section and being located within said gutter beneath said horizontal support members;

said strip having a width dimension sufficient to traverse a cross-section of said gutter underneath said horizontal members having a first edge of said strip contacting a back wall of said gutter, a second edge of said strip contacting a front wall of said gutter and forming a U-shaped cross section; and said drain hole being located above said gutter downspout to facilitate draining.

6. An apparatus according to claim 5 further comprising:

a gutter-liner downspout adapter having a flange portion connected at a narrow end of said flange portion to a hollow portion;

said drain hole of said strip being smaller than a maximum dimension of said flange portion; and said flange portion being affixed in a watertight manner to said strip with an outer edge of said flange portion circumferentially located to said drain hole.

7. An apparatus according to claim 5 wherein said resilient material is a thermoplastic material.

8. An apparatus according to claim 5 wherein said resilient material is an elastomer.

9. An apparatus for lining a gutter according to claim 5, further comprising:

a first, preformed end piece affixed in a watertight manner to a first end of said strip; and a second, preformed end piece affixed in a watertight manner to a second end of said strip.

10. An apparatus according to claim 5 wherein said first edge and second edge contact said horizontal member and a central portion of said strip contacts a bottom surface of said gutter.

11. An apparatus for a waterproof lining of a gutter according to claim 5 wherein said gutter is of the case type having a substantially rectangular cross section.

12. A waterproof lining of a gutter having a first end, a second end, at least one corner, and a downspout, being supported by a plurality of horizontal members, comprising:

a first strip of waterproof, normally flat, resilient material of substantially uniform cross section having a drain hole therein;

a second strip of waterproof, normally flat resilient material of substantially uniform cross section;

said first strip having a length slightly shorter on each end than the length of said gutter in a first direction between said first end and said corner;

said first strip being resiliently deformed out of its flat shape to a U-shape transverse cross-section and being located within said gutter beneath some of said horizontal support members;

said second strip having a length slightly shorter on each end than the length of the gutter in a second direction from said corner to said second end;

said second strip being resiliently deformed out of its flat shape to a U-shape transverse cross-section and being located within said gutter beneath some of said horizontal support members;

said first and second strips each having a width dimension sufficient to traverse a cross-section of the gutter underneath said horizontal members having one end of each strip contacting a junction of a back wall of said gutter and one of said plurality of horizontal members, a second edge of each of said strips contacting a junction of a front wall of said gutter and one of said plurality of horizontal support members, and a respective central portion of each strip contacting a respective bottom portion of said gutter, thereby each strip forming a U-shaped cross section;

a first end piece affixed in a waterproof manner to a first end of said first strip;

a corner piece affixed in a waterproof manner to said first strip at a second end of said first strip;

a second end piece affixed in a waterproof manner to a first end of said second strip;

a second end of said second strip affixed in a waterproof manner to another end of said corner piece; and said drain hole being located above said gutter downspout to facilitate draining.

13. A lining according to claim 12 further comprising:

a downspout piece extending into said gutter having a flange portion connected at a narrow end of said flange portion to a hollow portion;

said drain hole above said gutter downspout being smaller than a maximum dimension of said flange portion; and said flange portion being affixed in a waterproof manner to said gutter-liner with an outer edge of said flange portion circumferentially located at said drain hole.

14. A lining according to claim 12 wherein said resilient material is a thermoplastic material.

15. A lining according to claim 12 wherein said resilient material is an elastomer. having a substantially rectangular cross section.

16. A waterproof lining of a gutter according to claim 12 wherein said gutter is of the case type having a substantially rectangular cross section.

17. A method for installing a gutter liner apparatus into gutters having a front sidewall, a rear sidewall, a left end, a right end, and a downspout, and said gutter supported by horizontal members, comprising the steps of:

inserting a first end of a continuous flat strip of waterproof, resilient material beneath said horizontal support members at a first end of said gutter, deforming said flat strip to a generally U-shape under the influence of the side walls of said gutter;

sliding said first end of said strip to a second end of said gutter beneath said horizontal members; and making an incision in said strip in the region above said downspout forming a drain hole opening communicating with said downspout.

18. The method of claim 17 wherein the step of making said incision comprises slitting said liner to form a plurality of flaps which extend downwardly into said downspout.

* * * * *

UNITED STATES PATENT AND TRADEMARK OFFICE

CERTIFICATE OF CORRECTION

PATENT NO. : 4,741,645

DATED : May 3, 1988

INVENTOR(S) : Richard W. Butler

It is certified that error appears in the above-identified patent and that said Letters Patent is hereby corrected as shown below:

Claim 15, Col. 11, line 9, delete "having a substantially rectangular cross-section."

Signed and Sealed this

Eleventh Day of October, 1988

*Attest:*

DONALD J. QUIGG

*Attesting Officer*

*Commissioner of Patents and Trademarks*